United States Patent [19]

Jaeger

[11] 4,018,369

[45] Apr. 19, 1977

[54] BACK SADDLE

[75] Inventor: Knut Jaeger, Kirchheim, Teck, Germany

[73] Assignees: Herbert Simon; Knut Jaeger, both of Bruckwiesen, Germany

[22] Filed: Feb. 13, 1975

[21] Appl. No.: 549,765

[30] Foreign Application Priority Data

Feb. 15, 1974 Germany ..... 052554[U]

[52] U.S. Cl. ..... 224/9; 224/8 R; 224/26 R

[51] Int. Cl.² ..... A45F 3/00

[58] Field of Search ..... 224/8 R, 8 A, 9, 25 A, 224/5 R, 26 R, 26 C, 26 D; 190/52, 43

[56] References Cited

UNITED STATES PATENTS

| | | | |
|---|---|---|---|
| 3,122,225 | 2/1964 | Ward | 190/52 |
| 3,410,376 | 11/1968 | Benzel | 190/52 |

FOREIGN PATENTS OR APPLICATIONS

| | | | |
|---|---|---|---|
| 908,399 | 4/1946 | France | 224/8 R |
| 71,268 | 12/1915 | Switzerland | 224/25 A |

OTHER PUBLICATIONS

Gerry Kiddie Pack, p. 26, 1965–1966 Winter Edition Gerry Catalogue.

*Primary Examiner*—Albert J. Makay
*Assistant Examiner*—Ross Weaver
*Attorney, Agent, or Firm*—Armstrong, Nikaido & Marmelstein

[57] ABSTRACT

A back saddle is provided having a back bag member worn at the rear of the waist of a person. A knapsack is attached to said back saddle preferably at the top side of said back bag. Said back bag serves the knapsack as a bottom and as an attachment to the person. The knapsack is additionally fixed to the body of the person through shoulder belts.

2 Claims, 4 Drawing Figures

BACK SADDLE

BACKGROUND OF THE INVENTION

The present invention relates to a new back saddle.

A "back saddle" as used herein is a device which is attached to the waist of a person and which contains a back bag, a container at the rear of the back saddle in which a hiker, skier or other user may conveniently transport small items. The back saddle is secured to the waistline of a user through belt means attached to the sides of the back bag and which themselves are closed together through locking means positioned at one end of each of the belt sections. The back saddle is preferably made of a flexible material such as a plastic which is weather resistant. The back bag is a curved pouch following the countour of the wearer's backside, and is generally opened through a zipper which runs the entire width of the back bag.

Such "back saddles" have been extremely popular in the Alps and in Bavaria are well known as the *Wimmerl*, a standard item for hiking enthusiasts and skiers. Another traditional item of the hiker and skier is the knapsack. In the past, a hiker or skier has chosen a rucksack when he wishes to transport a change of clothes. Where he does not need the large capacity of a rucksack, but only needs a small volume to transport items such as gloves, small change for refreshments at the mountaintop, and other minor items, a Wimmerl, or back saddle, has been preferred. Because of the extreme bulkiness of a knapsack, one who chooses a Wimmerl will not take along an empty rucksack, and is faced with not having adequate storage for sweaters or coats when the weather suddenly turns warm or for gathering items collected in the forest, such as mushrooms, plant specimens and the like. Thus, one of the drawbacks of the Wimmerl is that the small amount of space precludes the possibility of conveniently storing clothes shed due to weather conditions or gathering items from the forest.

The rucksack of course is one alternative to the Wimmerl. However, when it is unlikely that the large volume of the rucksack will be needed for an afternoon's skiing or hiking, the Wimmerl has generally been chosen due to the greater freedom of movement which the Wimmerl gives the wearer. Thus, the likelihood of needing a larger volume provided by the rucksack is forsaken for the convenience of the Wimmerl. Thus it is often the case that skiers making long trips who would like the larger capacity of the knapsack choose the Wimmerl because of its greater freedom of movement. This particularly creates a problem for family outings because children often wish to shed outer clothing or wish to collect items from the forest, but are unwilling to carry them. Here, the user of the Wimmerl is unable to fit such bulky items into his small carrying back bag and the parent is faced with carrying the child's objects.

It is therefore an object of the invention to provide the user of the Wimmmerl with knapsack opportunities without adding to the inconvenience of the user of the Wimmerl when the knapsack capability is not needed.

SUMMARY OF THE INVENTION

A back saddle is provided having a back bag member worn at the rear of the waist of a person and a knapsack attached to said back saddle. The knapsack is fixed to the body of the person through shoulder belts.

THE DRAWINGS

The invention is illustrated by the drawings, wherein.

DETAILED DESCRIPTION

It is proposed according to the invention with respect to a back saddle of the known type that a knapsack is attached to the back bag and provided with carrying straps that can be put over each shoulder of the person and that can be fitted detachable to the back saddle or the belt with adjusting means provided at its ends. Thus, the employer of such a saddle always has a knapsack available in addition to the back bag, if needed, the knapsack having a much larger volume of capacity than the saddle.

It is advantageous to connect the knapsack fixedly to the back saddle, foldable and fixed onto the saddle in its folded condition. The knapsack can thereby be folded when it is no longer needed and placed on the back saddle. In particular, when thin but long-wearing materials are used for the knapsack, this knapsack is very light and thus increases the weight of the saddle only immaterially.

It is an especially material-saving embodiment when the top side of the saddle forms simultaneously the bottom portion of the knapsack and when the container for receiving the folded portion of the knapsack is formed of two top flaps and the top side of the bag forming simultaneously the bottom of the portion of the knapsack, the top flaps being foldable over the folded portion of the knapsack and can be connected with each other by suitable locking means.

Figure 1:
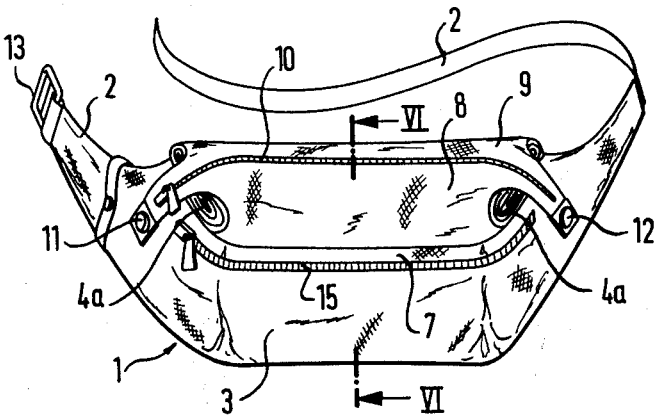
FIG. 1 is a perspective view of a back saddle including a knapsack folded into the top of the back saddle and enclosed in a closed member.
Figure 2:
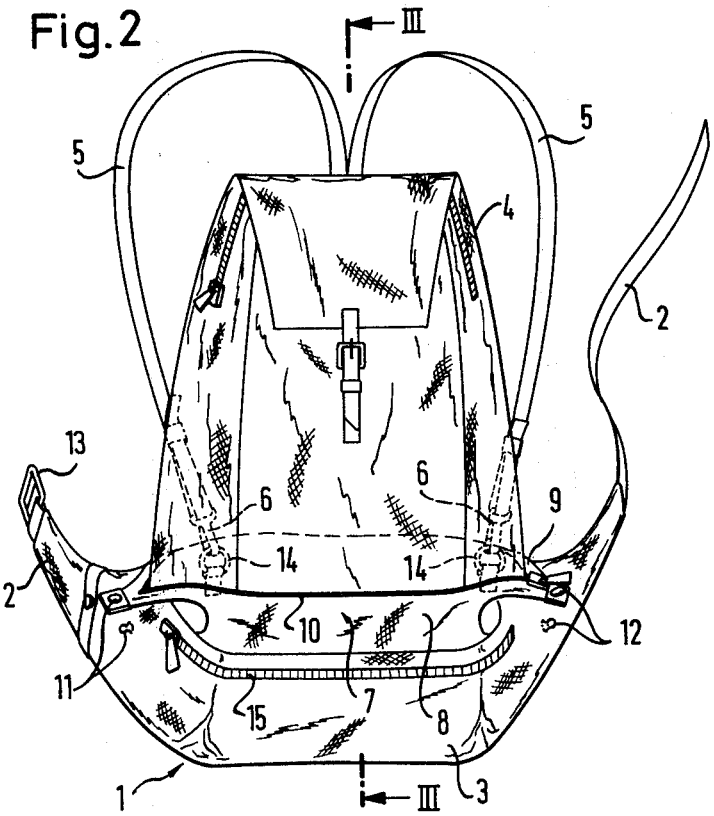
FIG. 2 is a perspective view of the saddle according to FIG. 1 with the knapsack in its opened form.
Figure 3:
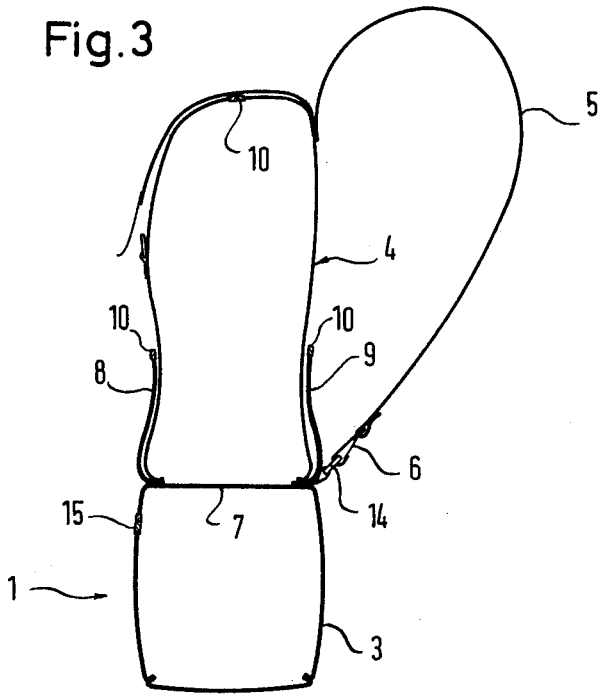
FIG. 3 is a sectional view along line III—III in FIG. 2.
Figure 4:
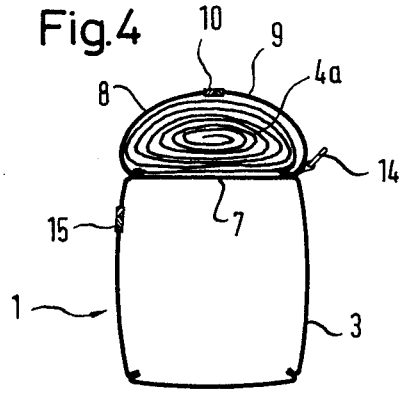
FIG. 4 is a sectional view along line IV—IV in FIG. 1.

The back saddle 1 consists essentially of a back bag 3 of preferably flexible material, that can be put around the waist of a person by means of belt sections 2 attached to said back saddle, and comprising a pouch closable with a zipper 15. This back bag 3 serves for receiving small objects, provisions or other utensils taken along by a person typically on a mountain hike and is put against the back of the person while the belt sections 2 adjusted to the back bag fasten the waist so that the saddle 1 can be put tightly around the waist of the person. The one end of the belt section 2 comprises additionally as locking means a buckle 13 for taking up the end of the other belt section. A knapsack portion 4 is adjusted to the back bag 3 of the saddle 1, which knapsack portion can be put over the shoulders of the person with shoulder straps 5 and can be fastened with the ends of the straps to the bag 3 in eyelets 14 by means of clippers 6. This knapsack portion 4 is preferably formed of a material such as a light nylon to provide a light weight. The knapsack portion 4 is formed to be foldable together and connected with the back bag 3 preferably in a cooperative manner. In the illustrative embodiment shown the knapsack portion 4 is enclosed on the top side 7 of the bag 3 and simultaneously enclosed in its folded condition 4a in a lockable container at the top side 7 of the back bag 3. It is suitable when the top 7 of the bag forms simultaneously the bottom of the knapsack portion 4 (cf. FIG. 3), while the container for receiving the folded knapsack portion 4a is formed of two flaps 8, 9 attached to the top side 7 of the bag 3, foldable over the folded knapsack portion 4a and connectable with each other with a zipper 10. In the embodiment of the saddle 1 as shown the zipper 10 is adjustable at its two ends with press buttons 11, 12 to the bag 3. It is thereby achieved that the folded knapsack portion 4a can be stored away in a particularly compact manner at the back saddle 1.

A particular advantage of the back saddle according to the invention is that in view of the embodiment of the top 7 of the bag as a bottom for the knapsack portion 4, the back bag 3 may always be used independent of the folded or unfolded condition of the knapsack portion 4. When needed, the folded knapsack portion 4 stored away in the container of the back bag 3 is unfolded in a facile manner and put over the shoulders by means of the carrying straps 5 and hooked to the back bag 3 with the carrying strap ends 6. When the saddle 1 according to the invention is used in such a manner there is the possibility in view of the great capacity of the knapsack portion 4 relative to the actual back bag 3, e.g., to store away clothing that has become superflous during wandering or to carrying objects that have been found unexpectedly during a trip. When the belt 2 is fastened tightly, the saddle 1 comprising the unfolded knapsack portion 4 is especially well adjusted, for example, also when the person using it is skiing downhill. For closing the knapsack portion there is applied a zipper in a manner known per se, a cording that can be knotted and/or the top flap of a knapsack. These parts are well known and are not described in detail. It is also possible to adjust the shoulder straps 5 of the knapsack portion in their length in a known manner.

Within the scope of the invention it is also possible to shape the knapsack portion 4 additionally or by itself as a back carrying seat for children. In this case there is provided a seat bottom optionally adjustable in the knapsack portion 4 in a manner well known. Moreover, openings are provided in the side parts of the knapsack for putting through the children's legs. The arrangement of these openings depend on the direction in which the child to be carried is sitting. This possible embodiment of the saddle according to the invention is not shown in the drawings.

We claim:

1. A back saddle comprising a back bag member worn at the rear of the waist of a person; a belt means fixedly attached to said bag member, whereby said bag member is secured to the waist of the person; a knapsack fixedly attached to said back bag member; and shoulder belts which are additionally fixedly attached to said knapsack whereby said knapsack is secured to the shoulders of the person, wherein the top side of said back bag member forms the bottom of said knapsack, wherein said knapsack has greater carrying capacity than said back bag, including a closable container upon the top side of said back bag, for storing the knapsack in a folded, compact position and wherein said closable container comprises two top flaps attached to the top side of said back bag member, said top flaps being foldable over said folded knapsack, the two flaps being connectable with each other by suitable closing means.

2. A back saddle as recited in claim 1 wherein said closing means is a zipper, the two ends of which are securable to said back bag member with press buttons.

* * * * *